United States Patent [19]

DePodesta et al.

[11] 4,202,318

[45] May 13, 1980

[54] HEATING APPARATUS

[76] Inventors: Thomas C. DePodesta, 24145 Colonial Dr., Woodhaven, Mich. 48183; Milton Moss, 30730 Hunter Dr., Farmington Hills, Mich. 48024

[21] Appl. No.: 891,424

[22] Filed: Mar. 29, 1978

[51] Int. Cl.[2] ..... F24H 3/02

[52] U.S. Cl. ..... 126/110 R; 126/99 D; 126/99 R; 126/110 E; 126/111; 126/116 R

[58] Field of Search ..... 126/110 R, 116 R, 111, 126/114, 99 D, 110 A, 106, 104 R, 104 A, 110 E, 100, 101, 108; 110/27

[56] References Cited

U.S. PATENT DOCUMENTS

| | | | |
|---|---|---|---|
| 2,355,495 | 8/1944 | Zier | 126/110 R |
| 2,564,775 | 8/1951 | Besser | 126/110 R |
| 2,578,927 | 12/1951 | Esson | 126/111 |
| 2,579,047 | 12/1951 | Luty | 126/110 R |
| 2,622,585 | 12/1952 | Rifle | 126/110 R |
| 3,076,449 | 2/1963 | Jacobs | 126/116 R |
| 3,171,400 | 3/1965 | Heiman | 126/110 R |
| 3,312,212 | 4/1967 | Wilson | 126/110 R |
| 3,779,230 | 12/1973 | Muckelrath | 126/116 R |
| 4,047,515 | 9/1977 | Daniel | 126/110 R |
| 4,141,335 | 2/1979 | Wright | 126/111 |

*Primary Examiner*—James C. Yeung

*Assistant Examiner*—Daniel J. O'Connor

*Attorney, Agent, or Firm*—Cullen, Sloman, Cantor, Grauer, Scott & Rutherford

[57] ABSTRACT

The multipurpose heating apparatus comprises a hollow and closed elongated metal casing forming a combustion chamber which is fixedly mounted within a closed insulated elongated housing, with the combustion chamber casing being spaced from the top, side walls and part of the bottom wall of the housing to define an air circulating passageway. Air supply blower means is connected to one end of the air circulating passageway while the other end of the passageway is connected to an air return passage provided in the bottom wall of the housing. The combustion chamber is divided into a solid waste fuel burning zone and into a gas or liquid fuel burning zone. Fuel burned within the combustion chamber transfers heat to the metal casing which radiates the heat into the air circulating passageway. The blower means is effective to direct air into the heating chamber and to transmit same through the air circulating passageway across the combustion chamber casing to pick up the heat radiating therefrom, with the heated air exiting the air circulating passageway through the air return passage from where the heated air may be directed to atmosphere or to an air supply system.

15 Claims, 5 Drawing Figures

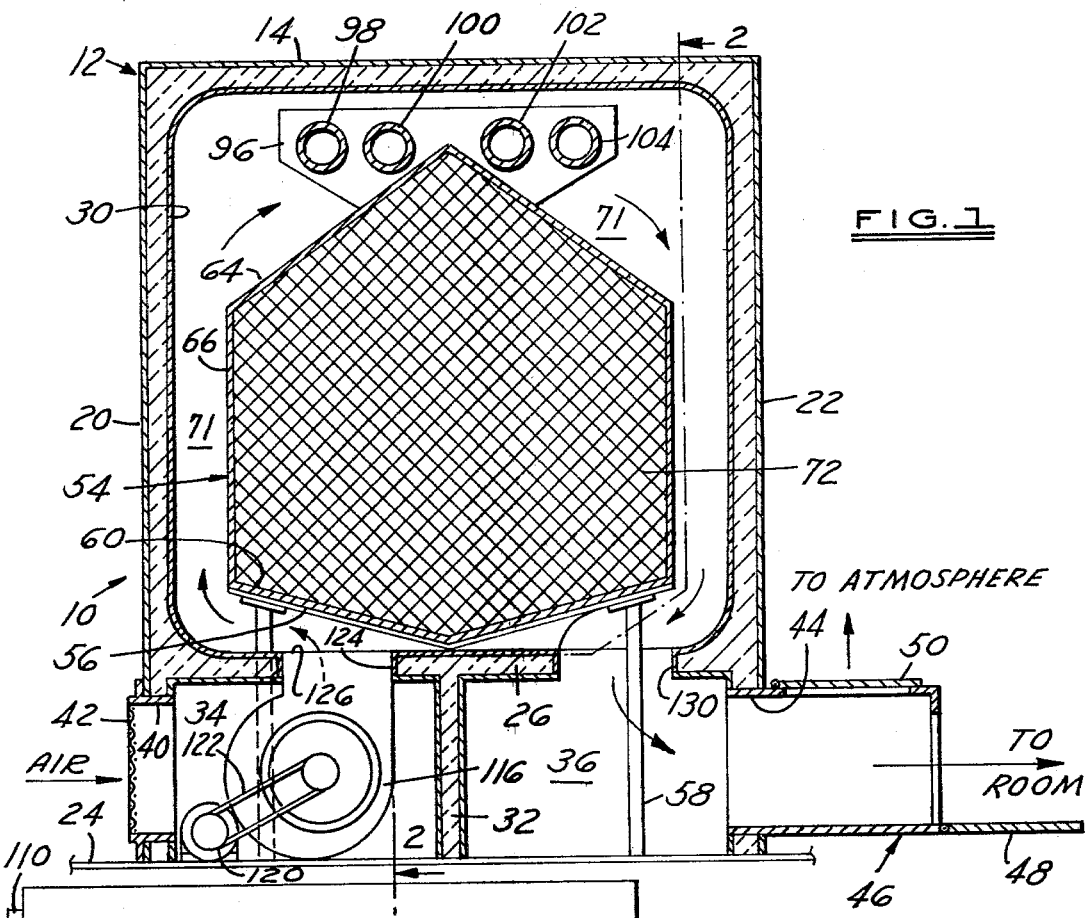
FIG. 1
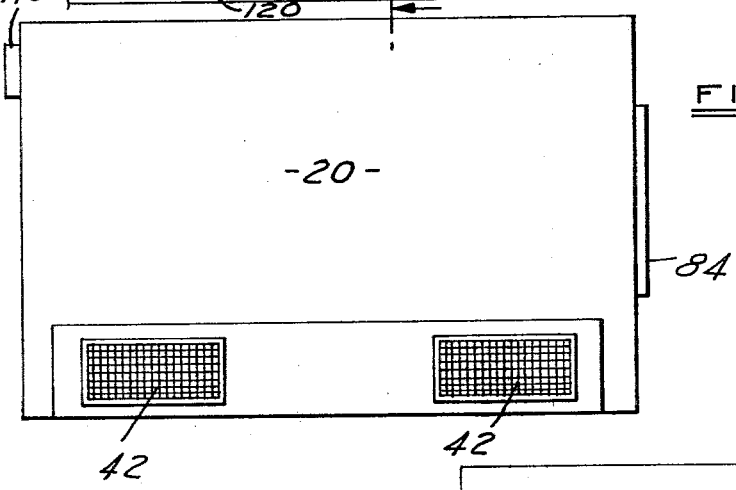
FIG. 3
FIG. 4
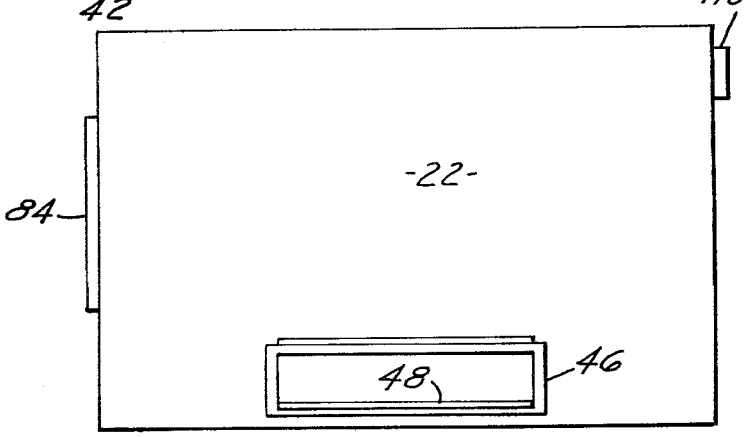

HEATING APPARATUS

BACKGROUND OF THE INVENTION

1. Field of the Invention

This invention relates generally to a multipurpose heating apparatus which provides for (a) standard heating and ventilating; (b) waste incineration; and (c) waste heat recovery. The apparatus includes primary means of heat generation which is obtained from either oil firing, gas firing or the like and in addition provides for secondary means of heat generation whereby waste materials or other solid fuels may be utilized and heat recovered from the combustion process.

2. Description of the Prior Art

Heating apparatuses are known which put out a large volume of constant temperature heated air for heating exterior work areas such as encountered in construction, at loading areas and the like. These heating apparatuses enable work to be performed even under extremely cold weather conditions. Such heaters, however, are usually fired by primary means of heat generation obtained from oil firing, gas firing or the like. Such heaters or heating apparatuses are classified as indirect and direct-fired and by the types of fuel burned. An indirect-fired heater is disclosed in U.S. Pat. No. 3,388,697. An indirect-fired heater is one where the air being heated is not contacted directly by the combustion gases generated. The prior art heaters are basically designed and constructed as either a direct or an indirect-fired heater and are further intended to burn only a designated type of fuel, which is usually a fuel oil or gas.

A search of the prior art resulted in the following U.S. Pat. Nos.: 3,779,230 to Ernest R. Muckelrath; 3,190,280 to J. Pirincin; 3,171,400 to J. L. Heinman; 3,076,449 to H. Jacobs; 3,028,855 to J. W. Brown, Jr.; 2,873,736 to R. W. Ross; 2,789,520 to M. Rowland; and 2,579,047 to D. J. Luddy. Such prior art patents fail to disclose a multipurpose heating apparatus which will provide not only heating and ventilating but will also permit solid waste incineration and the recovery of heat generated by the combustion of solid fuels.

SUMMARY OF THE INVENTION

The multipurpose heating apparatus is in the form of an indirect type heat exchanger furnace unit which contains primary and secondary means of heat generation. The stainless steel heat exchanger casing forming the combustion chamber is divided into two burning zones, one burning zone for solid fuels providing the secondary means of heat generation, as an example, solid waste materials such as cardboard cartons, papers, rags etc., and the other burning zone for gas or liquid fuels providing the means of heat generation. The air directed into the housing of the furnace unit contacts the combustion chamber casing and removes heat therefrom and the heated air is directed in a predetermined path to a duct or distribution system for subsequent use.

It is a feature of the present invention to provide a heating apparatus of the aforementioned type wherein the primary means of heat generation is obtained from oil firing, gas firing, propane or the like.

It is a further feature of the present invention to provide a heating apparatus of the aforementioned type wherein the heat exchanger casing forming the combustion chamber has the two burning zones separated by an expanded metal retainer wall or barrier. The solid fuel burning zone is charged with number one waste such as cardboard or paper which is burned and the heat generated thereby is recovered. If there is an insufficient quantity of waste material to be burned, the apparatus includes a control system which activates the primary heat generation combustion equipment which heats the heat exchanger casing and the heat is transferred to the air circulated across the casing and the heated air is directed to the distribution system.

It is a still further feature of the present invention to provide a heating apparatus of the aforementioned type wherein air required for the combustion of the solid waste materials is supplied by the combustion air blower forming part of the primary heat generation combustion equipment and is directed to the solid waste burning zone through the expanded metal retainer wall or barrier.

Another feature of the present invention is to provide a heating apparatus of the aforementioned type which can be used for cremating purposes, with the heat resulting therefrom used to heat a funeral chapel or a mausoleum or directed to any heating system of a building, such as a supermarket or even to outside areas requiring heat such as loading dock areas of industrial plants.

Still another feature is to provide a heating apparatus of the aforementioned type which can be used for incineration purposes in the out-of-heat season, thus disposing of waste materials thereby eliminating the necessity of pailing and hauling away the waste material. The heated air resulting therefrom is vented to atmosphere.

It is still another feature of the present invention to provide a heating apparatus of the aforementioned type which is efficient in operation, easy to manufacture and assemble, economical in construction and operation and complies with environmental and safety laws, codes, and regulations.

BRIEF DESCRIPTION OF THE DRAWINGS

FIG. 1 is a transverse sectional view through the heating apparatus taken on the line 1—1 of FIG. 2;

FIG. 3 is a left hand end view of the heating apparatus shown in FIG. 1;

FIG. 4 is a right hand end view of the heating apparatus shown in FIG. 1; and

DESCRIPTION OF THE PREFERRED EMBODIMENT

Figure 2:
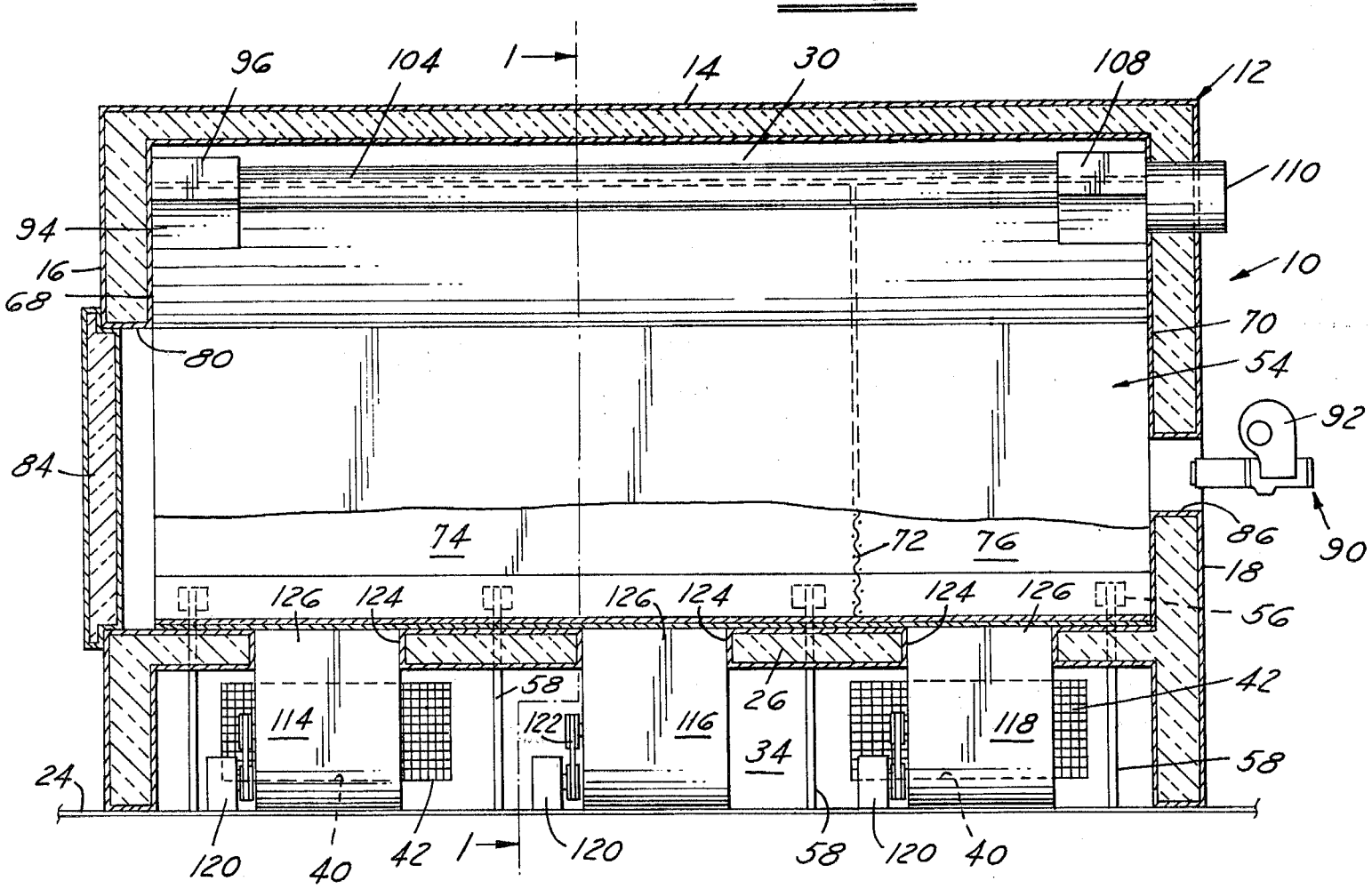
FIG. 2 is a longitudinal sectional view through the heating apparatus taken on the line 2—2 of FIG. 1.

Referring now to the drawings, a multipurpose heating apparatus 10 is illustrated which is designed to provide standard or conventional heating and ventilating, solid waste incineration and heat recovery from the combustion of the solid waste materials. The heating apparatus 10 comprises an elongated insulated housing 12 having a top wall 14, a front wall 16, a back wall 18 and a pair of side walls 20 and 22. The front, back and side walls extend vertically from the top wall to a ground level slab 24 as noted in FIGS. 1 and 2. A bottom wall 26 is spaced above and generally parallels the ground level slab 24 and is connected to portions of the front, back and side walls intermediate the ends thereof. The bottom and top walls 14 and 26 along with the front, back and side walls 16, 18, 20 and 22 define or form an elongated hollow heating chamber 30. The walls of housing 12 are each comprised of a plurality of insulated panels. Each panel is made from inner and outer steel plates having fiberglass or other insulation material therebetween as is well known in the art. As an example, the thickness of the top, bottom and side panels is three inches while the thickness of the front and rear panels is six inches.

The portion of the heating apparatus 10 below the bottom wall 26 is divided by a centrally located and vertically extending barrier or wall 32 which extends from the front wall 16 to the back wall 18 parallel to the side walls 20 and 22. Wall 32 is comprised of a plurality of insulated panels like the other walls of the housing 12.

One side of the barrier or wall 32 defines an air intake zone 34 while an air exit zone 36 is located at the other side of the barrier 32. The zones 34 and 36 extend longitudinally from the front wall 16 to the back wall 18. The lower portion of the side wall 20 is provided with a pair of air intake openings 40 provided with screens 42 and through which air may be drawn into the air intake zone 34. The other side wall 22 is provided with an air exit opening 44 which is provided with a directional duct 46. The duct 46 has a pair of hingedly connected doors or dampers 48 and 50 for controlling the flow of heated air from the air exit zone to an air supply system through open door 48 or to the atmosphere through open door 50.

Located within the interior of the heating chamber 30 is a hollow, substantially closed elongated metal casing 54 forming a combustion chamber which is fixedly mounted within the heating chamber 30 by means of a plurality of bracket and post assemblies 56. The assemblies 56 are spaced longitudinally apart along the length of the housing 12. The posts 58 of assemblies 56 extend through openings provided in the bottom wall 26, with the lower portions thereof secured to the foundation or ground level slab 24 of the apparatus 10. The bracket and post components of assembly 56 are welded together and the bracket is welded to the casing 54 which is made from stainless steel.

The metal combustion chamber casing 54 has a bottom member 60, a top member 62 and parallel vertical side members 66. The top member 62 is divided into a pair of integral flat sections which form a gable shaped top for the combustion chamber casing 54 as shown in FIG. 1. The top flat sections form an inverted "V", extend downwardly and away from the center and are secured to the upper edges of the parallel side members 66. The bottom member 60 is divided into a pair of integral flat sections which form a "V" or trough section, with the bottom flat sections abutting at the center, converging upwardly and away from the center and are secured to the lower edges of the parallel side members 66 as best noted in FIG. 1. The combustion chamber casing 54 has front and back panels 68 and 70 which abut the front and back walls 16 and 18 respectively.

The top, sides and part of the bottom of the casing 54 are spaced from the interior surfaces of the heating chamber walls to form an air circulating passageway 71 which surrounds casing 54.

The metal casing 54 is made from stainless steel and is provided on the interior thereof with an expanded metal vertically mounted retainer wall or barrier 72 which divides the interior of the combustion chamber into a solid waste burning zone 74 and into a gas or liquid fuel burning zone 76. The solid waste burning zone 74 is substantially longer than the other burning zone 76. The primary means of heat generation is obtained from burning zone 76 while the solid waste burning zone provides the secondary means of heat generation.

The front wall 16 is provided with a generally rectangular opening 80 and an aligned opening is provided in the opposing wall 68 of the combustion chamber casing 54. An insulated charge door, as an example, four inches thick, is hingedly carried by the front wall 16 and through which solid waste materials are introduced into the solid fuel burning zone 74 of the combustion chamber.

The back wall 18 is provided with an opening 86 which is aligned with a further opening provided in the back and opposing panel 70 of the metal casing 54. A conventional mechanical gas or liquid fuel burner assembly 90 is carried by or mounted on the back wall 18 for introducing fuel and air into the gas or liquid fuel burning zone 76. The burner assembly 90 includes a combustion air blower 92. The burner assembly 90 provides the primary means of heat generation and use oil firing, gas firing, LP gas or propane as is well knwon in the art.

The metal casing 54 at the front end thereof is provided with smoke exhaust exits 54, 94 forming a manifold 96 for four smoke exhaust tubes 98, 100, 102 and 104. The exhaust tubes are mounted above the metal casing 54 in a parallel relation as noted in FIGS. 1 and 2. The back ends of tubes 98, 100, 102 and 104 are carried by a back manifold 108 secured to casing 54 and to the interior of the housing 12. Smoke resulting from the combustion of the fuels within the combustion chamber is discharged through the smoke tubes to the exhaust pipe 110 which is mounted in and extends through the back wall 18 as shown in FIG. 2.

The apparatus 10 includes three air supply fan or blower means or assemblies 112, 114 and 116 which are provided in the air intake zone 34. The blowers or fans each are provided with a motor 120 which is connected by a pulley driven belt 122 to a pulley of the corresponding fan or blower 112, 114, 116 for energizing or driving same as shown in FIG. 2. An inlet passage 124 is provided in the bottom wall 26 between the air intake zone 34 and one end of the air circulating passageway 71. Each blower means has its discharge side 126 located in or adjacent the air inlet passage 124. One or more air return passages 130 are located in the bottom wall 26 between the other end of the air circulating passageway 71 and the air exit zone 36 as best illustrated in FIG. 1. Each blower means 114, 116, 118 transmits air from the air intake zone 34 into the heating chamber 30 and directs the air through the air circulating passageway 71 across the combustion chamber casing 54 as well as across the metal exhaust pipes 98, 110, 102 and 104 to pick up the heat radiating therefrom. The heated air is circulated through the air circulating passageway 71 and out through the air return passage or passages 130 which discharges the heated air into the air exit zone 36 from where the heated air may be directed to atmosphere via open door 50 or to an air supply system through open door 48.

Figure 5:
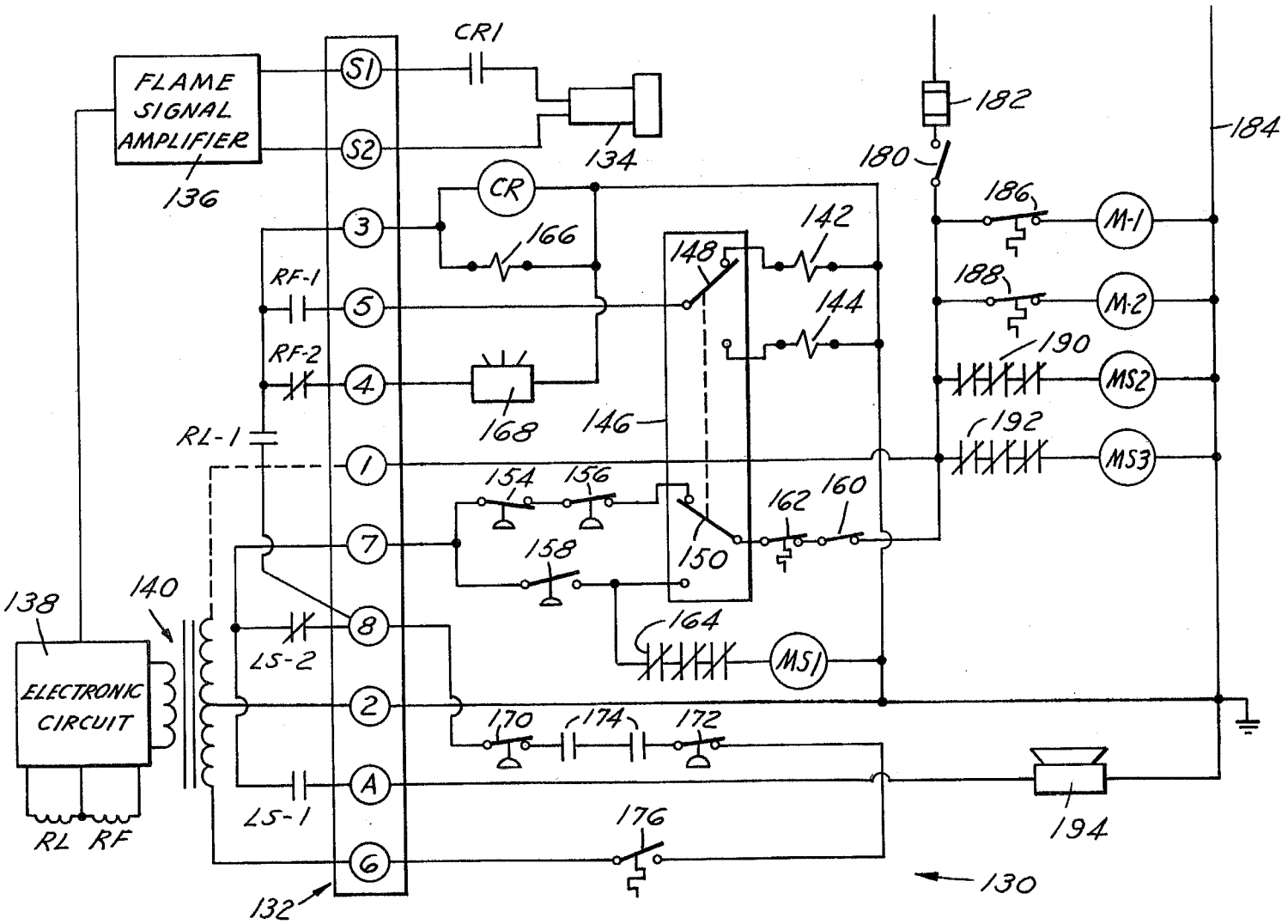
FIG. 5 is a simplified electrical circuit for use with the heating apparatus shown in the drawings.

The control circuit or wiring diagram 130 of FIG. 5 includes a UVM-2A 90 FIREYE control sold by Electronics Corporation of America, FIREYE Division, located at One Memorial Drive, Cambridge, Mass. 02142 and which is generally shown and described in Bulletin C-400 consisting of "UVM and TFM Commercial Flame Safeguard Controls".

The circuit diagram 130 includes a conventional terminal board 132 provided with terminals numbered S1, S2, 3, 5, 4, 1, 7, 8, 2, A, and 6. To the left of the terminal board 132 shown in FIG. 5 are the internal components of the circuit 130. To the right of the terminal board 132 are external components which are generally positioned and arranged with respect to the heating apparatus 10 to be serviced when required without undue difficulty.

A FIREYE UVM control provides a safe light-off sequence and flame monitoring for the heating and process burners using gas and/or light oil fuels. The UVM-2A control includes a miniature UV flame detector 134 which uses an ultraviolet-sensitive gas discharge tube to visually monitor radiation from the gas and light oil flames. The ultraviolet flame detector 134 is connected on one side by a normally open contact from relay CR to terminal S1 while the other side of the flame detector 134 is connected to terminal S2.

The internal components of the circuit diagram 130 are conventional and are generally shown in the aforementioned catalog and includes a flame signal amplifier 136 connected to terminals S1 and S2 and an electronic circuit 138 connected to the flame signal amplifier 136. The electronic circuit 138 forms an electronic time delay network. Connected across the electronic circuit 138 is a flame relay RF and a load relay RL. The electronic circuit 138 is connected to the transformer 140 which is connected across terminals 1 and 6.

The flame relay RF using direct current has contacts RF-1 and RF-2 which are connected across terminals 5 and 4 respectively. Contact RF-1 is normally open and contact RF-2 is normally closed. The load relay RL has a normally open contact RL-1. A conventional lockout switch has a pair of contacts LS-1 and LS-2. Contact LS-1 is normally open and contact LS-2 is normally closed.

The main gas valve 142 and the main oil valve 144 are controlled by a fuel changeover switch 146 whereby the upper switch arm 148 may be selectively urged in a direction to open either the gas valve 142 or the oil valve 144. The fuel changeover switch 146 includes a lower switch arm 150 which is moved simultaneously with arm 148 to connect to certain safety devices 154, 156 and 158 depending on whether valve 142 or 144 is activated.

Safety devices are provided including a high gas pressure switch 154, a low gas pressure switch 156 and an oil pressure switch 158. Such pressure switches 154, 156, 158 are connected via the fuel changeover switch 146 to the on/off switch 160 of the burner through the bonnett high temperature limit switch 162. Thermal overload protection 164 is in series with the motor starter MS1 which deenergizes the oil pump starter, oil pump and oil pressure switch to cause shutdown when the oil pump motor becomes faulty.

The contact relay CR connected to terminal 3 has to be complete to monitor the pilot. If the pilot is not detected, neither the gas valve 142 nor the oil valve 144 will open. The pilot solenoid valve 166 is actuated after a 90-second pre-purge prior to each start. The ignition transformer 168 creates a spark to ignite the gas pilot.

An air flow safety switch 170 is provided for the circulating air fan 116 and another switch 172 is provided for the combustion air fan which forms part of the burner 90. The circulating air and combustion air motor starter auxilliary contacts 174 are provided between switches 170 and 172. A master thermostat 176 is provided in the circuit between terminals 6 and 8 for final temperature control.

The circuit 130 includes an on/off switch 180 and a fuse 182 leading to the 120 volt, 50 or 60 cycle power source. The switch 180 is connected to the burner on/-off switch 160 as shown in FIG. 5.

The diagram 130 shows a ground line 184, a high temperature limit switch 186 in series with the mixing air damper motor M1; a high temperature limit swich 188 in series with the damper control motor M2; and thermal overload contacts 190 and 192 in series with the combustion air blower motor starter MS2 and the circulating air blower motor starter MS3 respectively. An alarm 194 is connected between terminal A and ground.

When the switch 180 is closed, the power is on and the high temperature limit switch, if closed will power the mixing air damper motor. The combustion and circulating air motors are powered through their starters. Terminal 8 is powered through LS-2. The purge air switches are proven, the motor starter interlocks are made and the master thermostat is closed causing terminal 6 to be powered. The transformer 140 is powered, and the Time Delay Network 138 is energized, initiating the prepurge timing.

At the completion of the purge, the RL relay is energized. When a flame is detected, relay RF is energized. In the event flame is not detected within ten seconds after the RL relay is energized, it is de-energized electronically opening the RL-1 contact which disconnects power to terminals 3, 4, and 5. Ten seconds later the lockout switch trips and de-energizes terminal 8 through LS-2 contact. LS-1 closes and terminal A is energized to sound alarm 194.

In the event of flame failure, fuel is interrupted in three seconds nominal, and ignition is not brought back on until after a new prepurge cycle. If pilot flame fails to reignite in ten seconds, the trial for ignition ends. Lockout occurs ten seconds later.

In the event that the flame relay is energized at any time during the prepurge, the Time Delay Network is returned to 0 seconds where the timing stops. If the flame relay remains energized for ten seconds lockout will occur, if the flame relay drops out within ten seconds, prepurge is re-established.

As noted previously, the heating portion of this unit is controlled by a thermostat and by a pair of motor operated dampers. The reason for this particular control system is that in the event the thermostat in the building to be heated is satisfied and the design does not require any additional heat, and should there be an accumulation of waste material being consumed in the unit, the ability to operate a bypass damper will divert heat to the atmosphere. Therefore, the unit can be used for incineration purposes in out-of-heat season, disposing of waste material, eliminating the necessity of bailing and hauling away.

To obtain maximum safety in the combustion equipment, the electronic ultraviolet primary control and sensing device as noted previously, is used. This control system monitors both pilot and main flame of the primary combustion equipment. In the event there is an abundance of waste material being burnt, combustion air will be supplied by the combustion air fan.

Should the system require a boost from the mechanical portion of the burner equipment, a relay is incorporated in the control circuit that permits the ignition cycle to be established. When terminal three is established, a flame detector is energized to prove the pilot and main flame, resulting in reliable return to burner flame detection.

To obtain maximum heat transfer from the combustion chamber to the heat distribution blower system, the combustion chamber is constructed of stainless steel which results in very efficient transfer of heat from the primary portion of the furnace, transferring heat to permit the blowers to obtain heat transfer and distribute same through the duct or distribution system.

What is claimed is:

1. A heating apparatus comprising an insulated elongated housing having a top wall, a front wall, a back wall and a pair of side walls, a bottom wall spaced above ground level and connected to portions of said front, back and side walls intermediate the ends thereof and defining therewith and with said top wall a normally closed heating chamber, a hollow substantially closed elongated metal casing forming a fuel combustion chamber and fixedly mounted within said heating chamber for burning combustible solid fuels and/or gas or liquid fuels, said casing and said combustion chamber having a longitudinally extending axis which is perpendicular to said front and back walls of said housing, said combustion chamber casing extending lengthwise in said housing from said back wall to said front wall of said housing and abutting same, said combustion chamber casing being spaced from said top and side walls and from portions of said bottom wall to define an air circulating passageway in said heating chamber which surrounds said combustion chamber casing, said air circulating passageway extending from said back wall to said front wall of the housing, said combustion chamber being divided into a solid fuel burning zone and into a gas or liquid fuel burning zone, an insulated charge door carried by said front wall and through which solid fuels are introduced into the interior of said combustion chamber, a gas or liquid fuel burner assembly carried by said back wall for introducing fuel and air into said gas or liquid fuel burning zone of said combustion chamber, a smoke exhaust tube system located in said heating chamber, means connecting said exhaust tube system to the interior of said combustion chamber, said exhaust tube system extending through said back wall and removing from the combustion chamber smoke resulting from the combustion of the fuels therein, a vertically extending barrier located below and outside of said normally closed heating chamber, the upper edge of said barrier being connected to said bottom wall and extending parallel to said side walls, said barrier also being connected to said front and back walls, an air intake zone at one side of said barrier and an air exit zone at the other side of said barrier, said air intake zone and said air exit zone being located below and outside of said normally closed heating chamber, air supply blower means in said air intake zone, an air inlet passage provided in said bottom wall between said air intake zone and one end of said air circulating passageway located in said heating chamber, said blower means having its discharge side located adjacent said air inlet passage, an air return passage in said bottom wall between the other end of said air circulating passageway and said air exit zone, said blower means transmitting air from said air intake zone into said heating chamber and directing the air through said air circulating passageway across said combustion chamber casing to pick up the heat radiating therefrom, with the heated air exiting said air circulating passageway through said air return passage which discharges into said air exit zone from where the heated air may be directed to atmosphere or to an air supply system.

2. The heating apparatus defined in claim 1 wherein the side wall of said housing opposite to and forming part of said air intake zone is provided with at least one air intake opening through which air is drawn into said air intake zone by said blower means.

3. The heating apparatus defined in claim 1 wherein the side wall of said housing opposite and forming part of said air intake zone is provided with a plurality of air intake openings through which air is drawn into said air intake zone by said blower means.

4. The heating apparatus defined in claim 3 wherein said air supply blower means comprises a plurality of motor driven air supply fans which are spaced apart in said air intake zone, each fan having a corresponding air inlet passage in said bottom wall between said air intake zone and said one end of the air circulating passageway.

5. The heating apparatus defined in claim 1 wherein the side wall of said housing opposite to and forming part of said air exit zone is provided with an air outlet opening through which the heated air may be directed to atmosphere or to an air supply system.

6. The heating apparatus defined in claim 1 wherein said charge door is hingedly mounted on said front wall and is received in aligned openings provided in the front wall of said housing and in the opposing end wall of said combustion chamber casing.

7. The heating apparatus defined in claim 1 wherein an expanded metal retainer wall is located in the interior of said combustion chamber and extends from said top member to said bottom member along said side members, said metal retainer wall dividing said combustion chamber into said solid waste fuel burning zone and into said gas or liquid fuel burning zone, said burner assembly serving a dual function for mixing air with the gas or liquid fuel to be burned in said gas or liquid fuel burning zone and for directing air through said gas or liquid fuel burning zone and said expanded metal retainer wall into said solid fuel burning zone to assist in the combustion of the solid fuels.

8. The heating apparatus defined in claim 1 wherein said metal combustion chamber casing is made from stainless steel.

9. The heating apparatus defined in claim 1 wherein said metal combustion chamber casing has a bottom member, a top member and a pair of parallel vertical side members, said top member being divided into a pair of flat sections which abut adjacent the center and extend downwardly and away from the center and are secured to the upper edges of said parallel side members, said bottom member being divided into a pair of flat sections which abut adjacent the center and converge upwardly and away from the center and are secured to the lower edges of said parallel side members.

10. The heating apparatus defined in claim 1 wherein said exhaust tube system comprises a plurality of tubes which are mounted over said combustion chamber casing and in a parallel relation, said tubes extending from said front wall to the back wall of said housing.

11. The heating apparatus defined in claim 1 wherein said combustion chamber casing is supported in said heating chamber by a plurality of bracket and post assemblies which are spaced apart, the bracket of each assembly being secured to the bottom of said combustion chamber casing, with the corresponding post being secured to the bracket and extending through an aperture in the bottom wall of said housing for engagement with the ground.

12. A heat exchanger furnace unit of the indirect type comprising an insulated housing having a top wall, a front wall, a back wall and a pair of side walls, a bottom wall spaced above ground level and connected to portions of said front, back and side walls intermediate the ends thereof and defining therewith and with said top wall a normally closed heating chamber, a hollow substantially closed elongated metal casing forming a fuel combustion chamber and fixedly mounted within said heating chamber for burning as the primary means of heat generation gas or liquid fuels and as the secondary means of heat generation solid materials, said casing and said combustion chamber having a longitudinally extending axis which is perpendicular to said front and back walls of said housing, said combustion chamber casing extending lengthwise in said housing from said back wall to said front wall of said housing and abutting same, said combustion chamber casing being spaced from said top and side walls and from portions of said bottom wall to define an air circulating passageway in said heating chamber which surrounds said combustion chamber casing, said air circulating passageway extending from said back wall to said front wall of the housing, said combustion chamber being a primary gas or liquid fuel burning zone and into a secondary solid material fuel burning zone, an insulated charge door carried by said front wall and through which solid materials are introduced into said secondary zone of said combustion chamber and providing the secondary means of heat generation, a gas or liquid fuel burner assembly carried by said back wall for introducing fuel and air into said primary gas or liquid fuel burning zone of said combustion chamber and providing the primary means of heat generation when said secondary means of heat generation is inoperative, a smoke exhaust tube system located in said heating chamber, means connecting said exhaust tube system to the interior of said combustion chamber, said exhaust tube system extending through said back wall, and removing from the combustion chamber smoke resulting from the combustion of the fuels therein, a vertically extending barrier located below and outside of said normally closed heating chamber, the upper edge of said barrier being connected to said bottom wall and extending parallel to said side walls, said barrier also being connected to said front and back walls, an air intake zone at one side of said barrier and an air exit zone at the other side of said barrier, said air intake zone and said air exit zone being located below and outside of said normally closed heating chamber, air supply blower means in said air intake zone, an air inlet passage provided in said bottom wall between said air intake zone and one end of said air circulating passageway located in said heating chamber, said blower means having its discharge side located in said air inlet passage, an air return passage in said bottom wall between the other end of said air circulating passageway and said air exit zone, said blower means transmitting air from said air intake zone into said heating chamber and directing the air through said air circulating passageway across said combustion chamber casing and said exhaust tube system to pick up the heat radiating therefrom, with the heated air exiting said air circulating passageway through said air return passage which discharges into said air exit zone from where the heated air may be directed to atmosphere or to an air supply system.

13. The heating apparatus defined in claim 12 wherein an expanded metal retainer wall is located in the interior of said combustion chamber and divides same into said solid waste fuel burning zone and into said gas or liquid fuel burning zone, said burner assembly serving a dual function for mixing air with the gas or liquid fuel to be burned in said gas or liquid fuel burning zone and for directing air through said gas or liquid fuel burning zone and said expanded metal retainer wall into said solid fuel burning zone to assist in the combustion of the solid fuels.

14. The heating apparatus defined in claim 13 wherein said exhaust tube system comprises a plurality of tubes which are mounted over said combustion chamber casing and in a parallel relation, said tubes extending from said front wall to the back wall of said housing.

15. The heating apparatus defined in claim 14 wherein said combustion chamber casing is supported in said heating chamber by a plurality of bracket and post assemblies which are spaced apart, the bracket of each assembly being secured to the bottom of said combustion chamber casing, with the corresponding post being secured to the bracket and extending through an aperture in the bottom wall of said housing for engagement with the ground.

* * * * *